US011643808B2

(12) United States Patent
Osmanski

(10) Patent No.: US 11,643,808 B2
(45) Date of Patent: May 9, 2023

(54) FACADE SUPPORT SYSTEM

(71) Applicant: Hohmann & Barnard, Inc., Hauppauge, NY (US)

(72) Inventor: Richard Osmanski, Hauppauge, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 0 days.

(21) Appl. No.: 16/929,455

(22) Filed: Jul. 15, 2020

(65) Prior Publication Data

US 2022/0018116 A1 Jan. 20, 2022

(51) Int. Cl.
*E04B 1/41* (2006.01)

(52) U.S. Cl.
CPC .... *E04B 1/4178* (2013.01); *E04B 2001/4192* (2013.01)

(58) Field of Classification Search
None
See application file for complete search history.

(56) References Cited

U.S. PATENT DOCUMENTS 4,875,319 A * 10/1989 Hohmann ..... E04B 1/98 52/383
5,408,798 A * 4/1995 Hohmann ..... E04B 1/4185 52/562
5,454,200 A * 10/1995 Hohmann ..... E04B 1/4178 52/379
5,634,310 A * 6/1997 Hohmann ..... E04B 1/4178 52/407.4
5,671,578 A * 9/1997 Hohmann ..... E04B 1/4178 52/562
5,816,008 A * 10/1998 Hohmann ..... E04B 1/7616 52/565
6,851,239 B1 * 2/2005 Hohmann ..... E04B 1/7616 52/379
7,017,318 B1 * 3/2006 Hohmann ..... E04B 1/4185 52/379
7,325,366 B1 * 2/2008 Hohmann, Jr. ..... E04B 1/4178 52/167.1

(Continued)

*Primary Examiner* — Joshua K Ihezie
(74) *Attorney, Agent, or Firm* — Levenfeld Pearlstein, LLC

(57) ABSTRACT

A veneer tie for use in a wall to join an inner wall member and an outer wall member of the wall. The outer wall member is formed from successive courses of masonry units with a mortar-filled bed joint between each two adjacent courses. The veneer tie has an installation axis that extends generally perpendicular to the outer wall member when the veneer tie is being used to join the inner wall member to the outer wall member. The veneer tie includes an attachment portion to be attached to a wall anchor used to secure the veneer tie to the inner wall member. An insertion portion of the veneer tie is coupled to the attachment portion that is to be disposed in the bed joint. The insertion portion includes a first recess and a second recess. The first recess is disposed at a first location on the insertion portion and the second recess disposed at a second location on the insertion portion. The first and second locations are spaced apart from one another in a direction parallel to the installation axis of the veneer tie. The first and second recesses receive a reinforcement member of a wall reinforcement.

10 Claims, 11 Drawing Sheets

(56) References Cited

U.S. PATENT DOCUMENTS 8,096,090 B1 * 1/2012 Hohmann, Jr. ..... E04H 9/02 52/513
8,122,663 B1 * 2/2012 Hohmann, Jr. ..... E04B 1/4185 52/379
8,726,596 B2 * 5/2014 Hohmann, Jr. ..... E04B 1/4178 52/379
8,726,597 B2 * 5/2014 Hohmann, Jr. ..... E04B 1/4178 52/379
8,839,581 B2 * 9/2014 Hohmann, Jr. ..... E04B 1/4178 52/379
8,984,837 B2 * 3/2015 Curtis ..... E04B 2/44 52/565
9,038,350 B2 * 5/2015 Hohmann, Jr. ..... E04B 1/7616 52/713
9,273,461 B1 * 3/2016 Hohmann, Jr. ..... E04B 1/4178
2004/0216408 A1 * 11/2004 Hohmann, Jr. ..... E04B 1/4178 52/426
2006/0005490 A1 * 1/2006 Hohmann ..... E04B 1/4178 52/293.3
2008/0141605 A1 * 6/2008 Hohmann ..... F16B 41/00 52/408
2010/0257803 A1 * 10/2010 Hohmann, Jr. ..... E04B 1/4178 52/405.1
2012/0304576 A1 * 12/2012 Hohmann, Jr. ..... E04B 1/4178 52/513
2013/0074442 A1 * 3/2013 Hohmann, Jr. ..... E04B 1/4185 52/712
2014/0000211 A1 * 1/2014 Hohmann, Jr. ..... E04B 1/4185 52/699
2014/0075855 A1 * 3/2014 Hohmann, Jr. ..... E04B 1/4178 52/167.1
2014/0075856 A1 * 3/2014 Hohmann, Jr. ..... E04B 1/4178 52/167.1
2014/0075879 A1 * 3/2014 Hohmann, Jr. ..... E04B 1/4178 52/712
2014/0250809 A1 * 9/2014 Hohmann, Jr. ..... E04C 1/00 52/309.1
2014/0260040 A1 * 9/2014 Hohmann, Jr. ..... E04B 1/4178 52/483.1
2015/0007521 A1 * 1/2015 Hohmann, Jr. ..... E04B 1/4178 52/562
2019/0127971 A1 * 5/2019 Stauffer ..... E04B 1/4178

* cited by examiner

FACADE SUPPORT SYSTEM

FIELD

The present disclosure generally relates to a facade support system used in building construction, and more specifically, to a veneer tie used to connect an outer wall member to an inner wall member of a wall.

BACKGROUND

A facade can be a durable and aesthetically desirable construction for a building exterior. Facades, such as brick or stone veneer walls, also provide protection to the interior of the building from the surrounding environment. Anchoring systems are used to secure facades (e.g., outer wythes) to inner wall members (e.g., inner wythes, stud frame walls, etc.) of a building to overcome forces which might pull the facade away from the building. These anchoring systems extend from the inner wall of the building to the facade. Generally, anchoring systems include veneer ties connected to the inner wall member with a wall anchor. The wall anchor is coupled to the veneer tie and is secured to the inner wall member, thereby attaching the veneer tie to the inner wall member. The veneer tie is embedded in a mortar bed joint of the facade to attach the veneer tie to the facade. Wall reinforcement may also be placed in and extend along the mortar bed joint of the facade and be connected to the veneer tie to strengthen the mortar bed joint, the facade and the connection between the mortar bed joint and the veneer tie.

SUMMARY

In one aspect, a veneer tie is used in a wall to join an inner wall member and an outer wall member of the wall. The outer wall member is formed from a plurality of successive courses of masonry units with a mortar-filled bed joint between each two adjacent courses. The veneer tie has an installation axis configured to extend generally perpendicular to the outer wall member when the veneer tie is being used to join the inner wall member to the outer wall member. The veneer tie comprises an attachment portion configured to be attached to a wall anchor used to secure the veneer tie to the inner wall member. The veneer tie also comprises an insertion portion coupled to the attachment portion and configured for disposition in the bed joint. The insertion portion includes a first recess and a second recess. The first recess is disposed at a first location on the insertion portion and the second recess is disposed at a second location on the insertion portion. The first and second locations are spaced apart from one another in a direction parallel to the installation axis of the veneer tie. The first and second recesses each being configured to receive a reinforcement member of a wall reinforcement.

In another aspect, an anchoring system is used in a wall to join an inner wall member and an outer wall member of the wall. The outer wall member is formed from a plurality of successive courses of masonry units with a mortar-filled bed joint between each two adjacent courses. The anchoring system comprises a wall anchor configured to be secured to the inner wall member. A wall reinforcement is configured for disposition in the bed joint. The wall reinforcement includes a first reinforcement member and a second reinforcement member. A veneer tie is configured to be coupled to the wall anchor and the wall reinforcement. The veneer tie has an installation axis extending generally perpendicular to the outer wall member when the veneer tie is used to join the inner wall member to the outer wall member. The veneer tie includes an insertion portion configured for disposition in the bed joint. The insertion portion includes a first recess and a second recess. The first recess is disposed at a first location on the insertion portion and the second recess is disposed at a second location on the insertion portion. The first and second locations are spaced apart from one another in a direction parallel to the installation axis. The first recess is configured to receive the first reinforcement member of the wall reinforcement and the second recess is configured to receive the second reinforcement member of the wall reinforcement.

In another aspect, a veneer tie is used in a wall to join an inner wall member and an outer wall member of the wall. The outer wall member is formed from a plurality of successive courses of masonry units with a mortar-filled bed joint between each two adjacent courses. The veneer tie has an installation axis extending generally perpendicular to the outer wall member when the veneer tie is used to join the outer wall member to the inner wall member. The veneer tie comprises an attachment portion configured to be attached to a wall anchor used to secure the veneer tie to the inner wall member. An insertion portion is coupled to the attachment portion and is configured for disposition in the bed joint. The insertion portion includes two or more holders spaced part from one another in a direction parallel to the installation axis. Each holder is configured to receive and hold a wall reinforcement extending along the bed joint at a location in the direction along the installation axis different than the other one or more holders.

Other objects and features of the present disclosure will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENT

Figure 1:
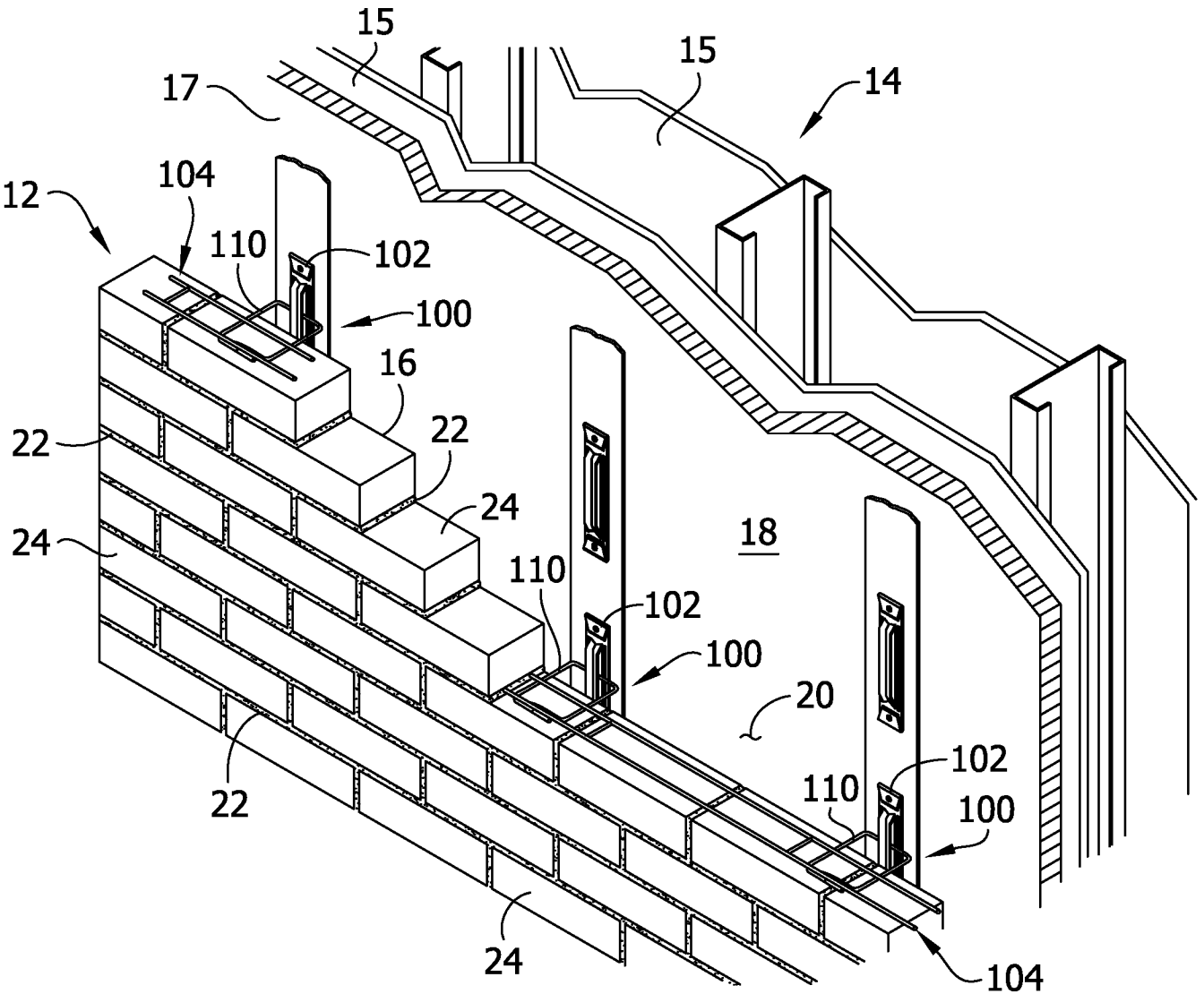
FIG. 1 is a perspective view of an anchoring system with a first embodiment of a veneer tie connecting an outer wall member to a stud frame inner wall member.
Figure 2:
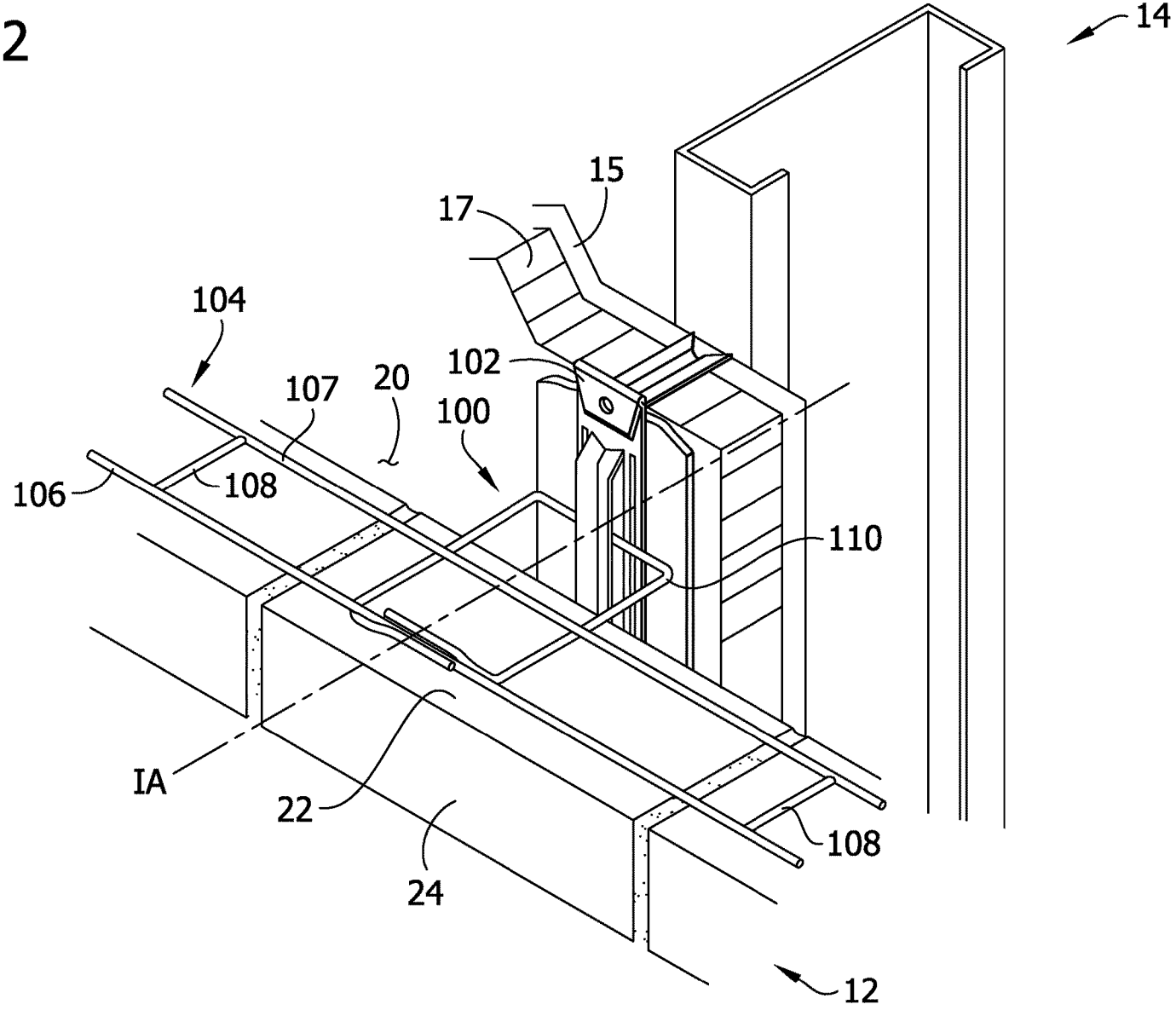
FIG. 2 is an enlarged, fragmentary view of the anchoring system of FIG. 1.

Referring to FIGS. 1 and 2, the first embodiment of an anchoring system connecting an outer wall member 12 to an inner wall member 14 of a building is indicated generally at 100. In this embodiment, a masonry wall structure is shown having the inner wall member 14 of stud frame construction including studs and wall panel members 15 (e.g., sheetrock, wallboard, plywood, gypsum board, etc.) on either side of the studs. The facade (e.g., veneer) or outer wall member 12 is shown as being of masonry construction. The outer wall member 12 has an interior surface or side. The inner wall member 14 includes insulation 17 mounted on the outer wall member 15. The inner wall member 14 has an exterior surface or side 18 defined by the insulation 17. The side 18 of the inner wall member 14 faces and is spaced from the interior surface 16 of the outer wall member 12. The inner wall member 14 may also be of concrete construction (not shown). Between the inner wall member 14 and outer wall member 12, a cavity 20 is formed separating the inner wall member 14 and outer wall member 12. It is to be understood that the inner and outer wall members may have other constructions than described herein that are within the scope of the present disclosure.

The outer wall member 12 has successive bed joints 22 filled with mortar formed between courses of masonry units 24 (e.g., bricks, stone, CMUs, etc.) and are substantially planar and horizontally disposed. The bed joints 22 are specified as to the height or thickness of the mortar layer and the thickness specification is adhered to so as to provide the requisite uniformity for quality construction. In accordance with building standards, the bed joints 22 are approximately 0.375 inches (0.9525 cm) in height in a typical embodiment. However, bed joints 22 of different heights are within the scope of the present disclosure. Select bed joints 22 receive a veneer tie 110 of the anchoring system 100 which extends from the bed joint 22 across the cavity 20 and is connected to the exterior surface 18 of the inner wall member 14. The anchoring system 100 includes a wall anchor 102 secured to the inner wall member 14 which couples the veneer tie 110 to the inner wall member. In this way, the veneer tie 110 anchors the outer wall member 12 to the inner wall member 14. In this embodiment, the wall anchor 102 is a folded wall anchor, further details of which may be found in U.S. Pat. Nos. 7,845,137 and 7,562,506, the entireties of which are hereby incorporated by reference.

Figure 4:
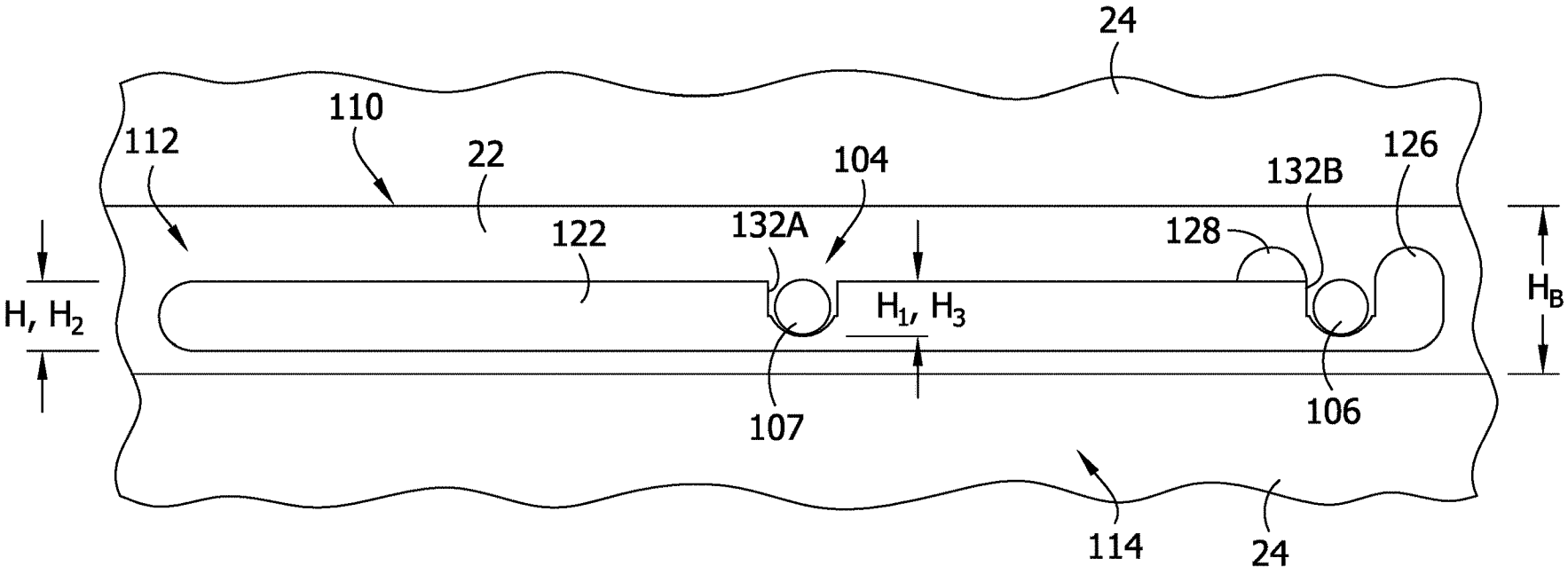
FIG. 4 is a side elevation view of the veneer tie and shows parts of a wall reinforcement of the anchoring system of FIG. 1.

The anchoring system 100 also includes wall reinforcement 104 for disposition in the bed joint 22, specifically the same bed joint at the veneer tie 110. The wall reinforcement 104 extends along the length of the wall in the bed joint 22 to reinforce and strengthen the bed joint. In the illustrated embodiment, the wall reinforcement 104 is a ladder type wall reinforcement that is embedded in the mortar of the bed joint 22 and generally overlies and/or underlies the veneer tie 110 in the bed joint. The ladder type wall reinforcement 104 has opposite first and second reinforcement members or legs 106 and 107, respectively. The first and second reinforcement members 106, 107 are generally parallel to one another and extend along the entire length of the wall reinforcement 104. Transverse (e.g., third) reinforcement members 108 extend between and interconnect the first and second reinforcement members 106, 107 at set intervals along the length of the wall reinforcement 104. The transverse reinforcement members 108 are generally perpendicular to the first and second reinforcement members 106, 107. Referring to FIG. 4, the wall reinforcement 104 has a wall reinforcement height $H_1$. The reinforcement members 106, 107, 108 have a generally arcuate (e.g., circular) cross-sectional shape. In the illustrated embodiment, the wall reinforcement 104 is a wire formative formed from 9 gauge (e.g., 0.148 inch (0.376 cm) diameter) wire, although other sizes of wire are within the scope of the present disclosure. The wall reinforcement may have other configurations and/or arrangements and the use of other types, configurations and/or arrangements of wall reinforcement with the anchoring systems disclosed herein is within the scope of the present disclosure.

Figure 3:
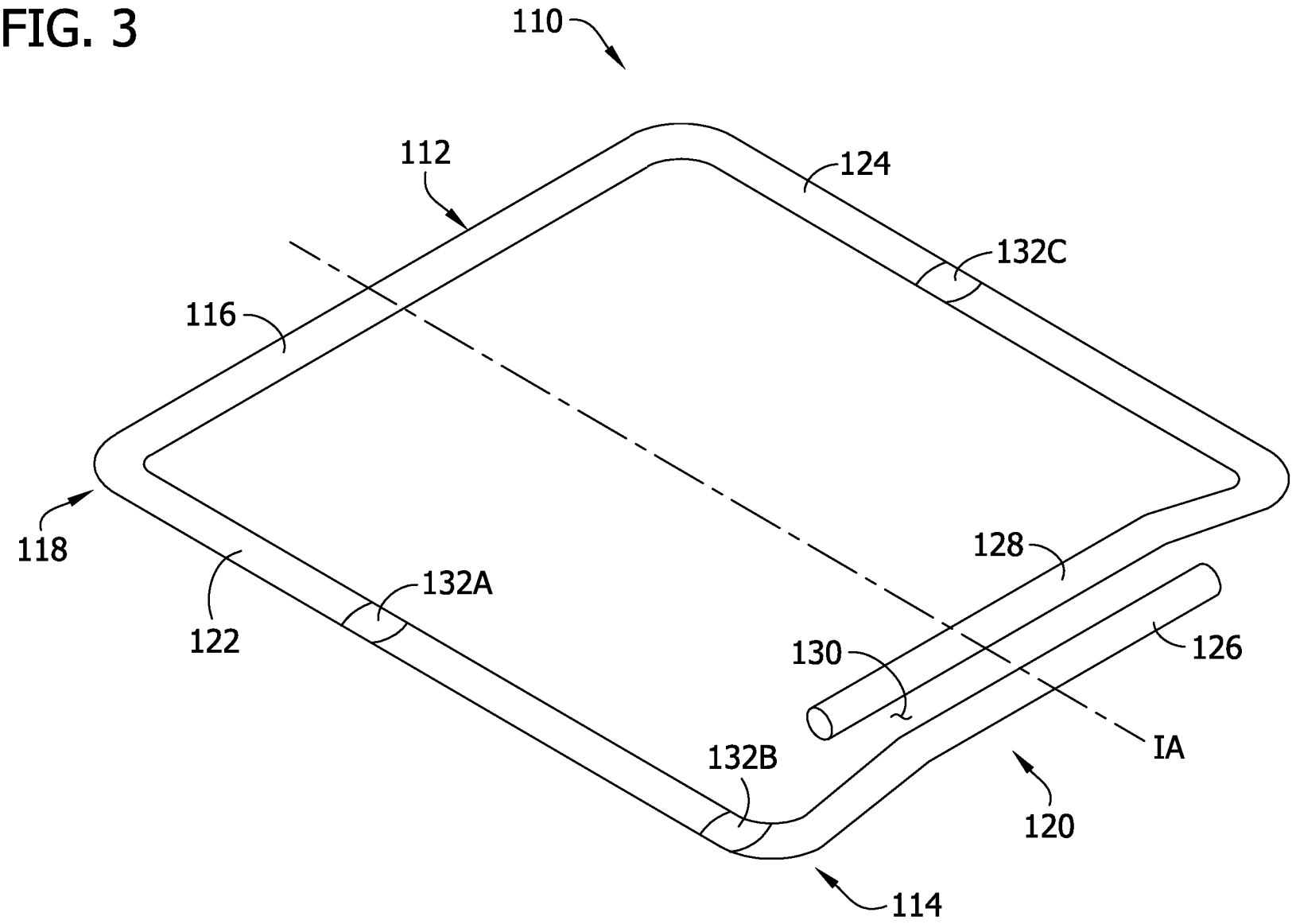
FIG. 3 is a further enlarged, perspective view of the veneer tie of FIG. 1.

The veneer tie 110 is configured to couple to the wall anchor 102 and the wall reinforcement 104. Referring now also to FIG. 3, the veneer tie 110 includes an attachment portion 112 and an insertion portion 114. In the illustrated embodiment, the veneer tie 110 is a one-piece (e.g., unitary) wire formative (e.g., made from a single piece of material) bent into the shape shown to define the attachment portion and the insertion portion. In other embodiments, the veneer tie 110 may be comprised of multiple wire formatives joined together in a suitable manner, such as by welding. In the illustrated embodiment, the veneer tie 110 is formed from 3/16 inch diameter wire, although other sizes of wire are within the scope of the present disclosure. The veneer tie 110 may be made from any suitable material such as steel or aluminum. The attachment portion 112 is configured to be attached to the wall anchor 102 to secure the veneer tie 110 to the inner wall member 14. In the illustrated embodiment, the attachment portion 112 includes a rear leg or segment 116 that extends through an opening in the wall anchor 102 to connect the veneer tie 110 to the wall anchor.

The insertion portion 114 is coupled or fixed to the attachment portion 112. The insertion portion 114 is configured for disposition in a bed joint 22. The insertion portion 114 generally extends outward in a direction from the attachment portion 112. As shown in FIG. 1, when installed, the insertion portion 114 extends generally horizontally across the cavity 20 to one of the bed joints 22 in the outer wall member 12. The insertion portion 114 has opposite first and second ends 118, 120. The first end 118 is coupled to the attachment portion 112 and the second end 120 is a free end to be embedded within the mortar bed joint 22. The veneer tie 110 has an installation axis IA that extends generally perpendicular to the outer wall member 12 when the veneer tie is used to join the inner wall member 14 and outer wall member (FIG. 2) (e.g., the insertion portion 114 is disposed in the bed joint 22). In the illustrated embodiment, the installation axis IA of the veneer tie 110 generally extends between the first and second ends 118, 120 of the insertion portion 114.

In the illustrated embodiment, the insertion portion 114 includes first and second segments 122, 124 each extending from opposite ends of the rear segment 116 of the attachment portion 112. The insertion portion 114 also includes first and second free end segments 126, 128 extending from ends of the first and second segments 122, 124, respectively. The first and second free end segments 126, 128 generally extend toward and along one another in a direction generally perpendicular to the installation axis IA. The first and second end segments 126, 128 are generally parallel to one another and spaced apart to define a gap 130 therebetween sized and shaped to receive a portion of the wall reinforcement 104. The gap 130 is open at one end and closed at the other end by the first segment 122. Portions of the first and second end segments 126, 128 are bent upward and disposed in a horizontal plane above the rest of the insertion portion 114 so that the end segments extend along and brace each side of the portion of the wall reinforcement 104 received in the gap 130 when the wall reinforcement overlies the insertion portion to link and join the veneer tie 110 and wall reinforcement together.

The insertion portion 114 includes a plurality of recesses 132, each recess configured to receive the wall reinforcement 104 when the wall reinforcement overlies the insertion portion. In particular, each recess 132 is arranged and sized and shaped to receive one of the first and second reinforcement members 106, 107 of the wall reinforcement 104. In the illustrated embodiment, the insertion portion 114 includes three recesses 132A, 132B, 132C (e.g., first, second and third recesses), although the insertion portion may include more or fewer recesses. In the illustrated embodiment, each recess 132 is swaged to correspond to the arcuate cross-sectional shape of the first and second reinforcement members 106, 107, although other shapes are within the scope of the present disclosure. The recesses 132 are disposed at locations on the insertion portion 114 where the wall reinforcement 104 crosses the insertion portion 114. In the illustrated embodiment, at least two of the recesses 132 are disposed at different locations (e.g., different longitudinal locations) on the insertion portion 114 which correspond to the different locations the first and second reinforcement members 106, 107 will cross the insertion portion. For example, the first recess 132A is disposed at a first location on the insertion portion 114. This first location is on the first segment 122 and corresponds to the location where the second reinforcement member 107 crosses the first segment. Likewise, the second recess 132B is disposed at a second location on the insertion portion 114. This second location is on the first segment 122 and corresponds to the location where the first reinforcement member 106 crosses the first segment. Thus, the first and second locations are spaced apart from one another in a direction parallel to the installation axis IA of the veneer tie 110. This spacing corresponds to the arrangement of the first and second reinforcement members 106, 107, which are spaced apart relative to the installation axis IA of the veneer tie 110. In this embodiment, the first and second recesses 132A, 132B are axially aligned with one another (e.g., are arranged such that an imaginary line extending therebetween is generally parallel to the installation axis IA). In addition, the second recess 132B (e.g., the second location) is laterally aligned with the gap 130 (e.g., are arranged such that an imaginary line extending therebetween is generally perpendicular to the installation axis IA) which also receives the first reinforcement member 106. In the illustrated embodiment, the third recess 132C is disposed at the first location (e.g., is laterally aligned with the first recess 132A) on the insertion portion 114 and is laterally spaced apart from the first recess. Broadly, the third recess 132C or any additional recesses can be laterally spaced apart from one of the first or second recess 132A, 132B so that the third or additional recesses receive the same reinforcement member 106, 107 of the wall reinforcement 104 that the first or second recess receives. The third recess 132C is disposed on the second segment 124 at the location that corresponds to where the second reinforcement member 107 crosses the first segment. It is understood that recesses 132 can be placed at generally any intersection point between the veneer tie 110 and the wall reinforcement 104.

The recesses 132 further link and join the veneer tie 110 and wall reinforcement 104 together, strengthening the connection between the two, which may be necessary for certain building applications (e.g., seismic construction). In this manner, the veneer tie 110 is coupled to the wall reinforcement. In addition, the recesses 132 reduce the overall or combined thickness or height H of the veneer tie/wall reinforcement assembly. In the illustrated embodiment, the combined height H (see, FIG. 4) generally extends between a lower end of the insertion portion 114 to an upper end of the wall reinforcement 104 or upper end of the insertion portion, whichever is higher. It is understood the combined height H does not necessarily extend between the lower most point and the upper most point of the insertion portion 114/wall reinforcement 104 but from two vertically aligned points. Building codes generally require the mortar height or thickness of the bed joint 22 to be at least twice the thickness of the veneer tie/wall reinforcement assembly embedded therein. By recessing the wall reinforcement 104 into the recesses 132 of the veneer tie 110, the combined height H is reduced, permitting a thinner mortar height of the bed joint 22 to be used (e.g., the combined height H is equal to or less than half the bed joint height). For example, in one embodiment, the veneer tie 110 and wall reinforcement 104 described herein can be used with a standard ⅜ inch thick mortar bed joint 22. The insertion portion 114 has an insertion portion height $H_2$. The insertion portion height $H_2$ is measured from a lower end of the insertion portion 114 to and upper end of the insertion portion, the lower and upper ends being vertically aligned. Preferably, the insertion portion height $H_2$ is greater than the wall reinforcement height $H_1$. When the wall reinforcement 104 overlies the veneer tie 110, the combined height H is less than the sum of the insertion portion height $H_2$ and the wall reinforcement height $H_1$ because the first and second reinforcement members 106, 107 are received in the recesses 132. In the illustrated embodiment, the combined height H is about the same as the insertion portion height $H_2$. The recesses 132 have a recess height $H_3$. In one embodiment, the recess height $H_3$ is equal to or greater than the wall reinforcement height $H_1$. In the illustrated embodiment, the recess height $H_3$ is about the same as the wall reinforcement height $H_1$.

In operation, the wall anchor 102 is used to secure the veneer tie 110, via the attachment portion 112, to the inner wall member 14. The insertion portion 114 is in a substantially horizontal plane with the bed joint 22. The insertion portion 114 extends across the cavity 20 into the bed joint 22. The first and second segments 122, 124 extend from the attachment portion 112 across the cavity 20 and into the bed joint 22. The wall reinforcement 104 extends along the bed joint 22 and overlies the insertion portion 114 and is disposed within the recesses 132 and gap 130 of the veneer tie 110. The wall reinforcement 104, the first and second free end segments 126, 128 and a portion of each of the first and second segments 122, 124 are surrounded by (e.g., embedded within) the mortar and secured within the bed joint 22.

Figure 5:
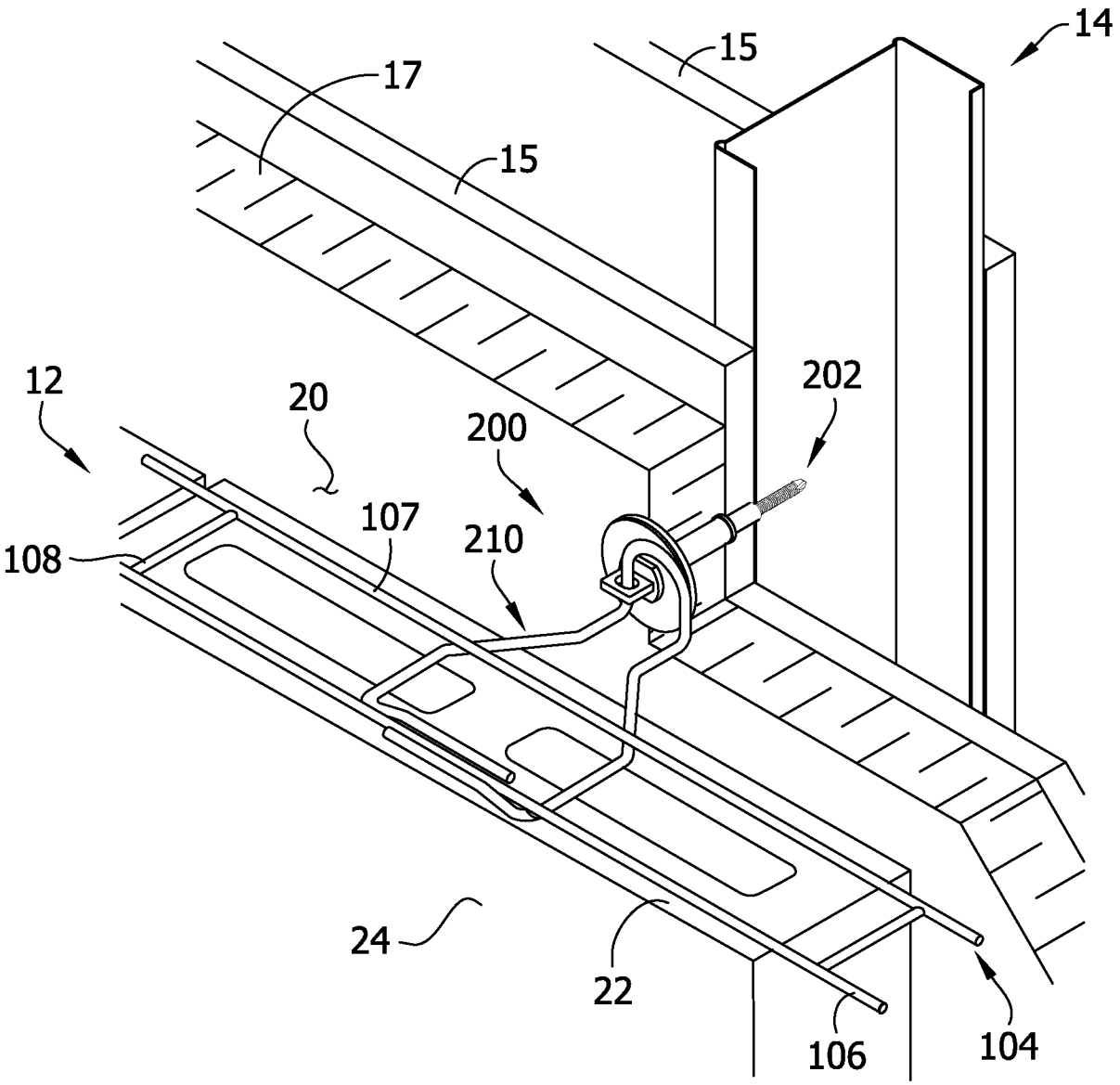
FIG. 5 is a perspective view of another anchoring system with a second embodiment of a veneer tie connecting an outer wall member to a stud frame inner wall member.
Figure 6:
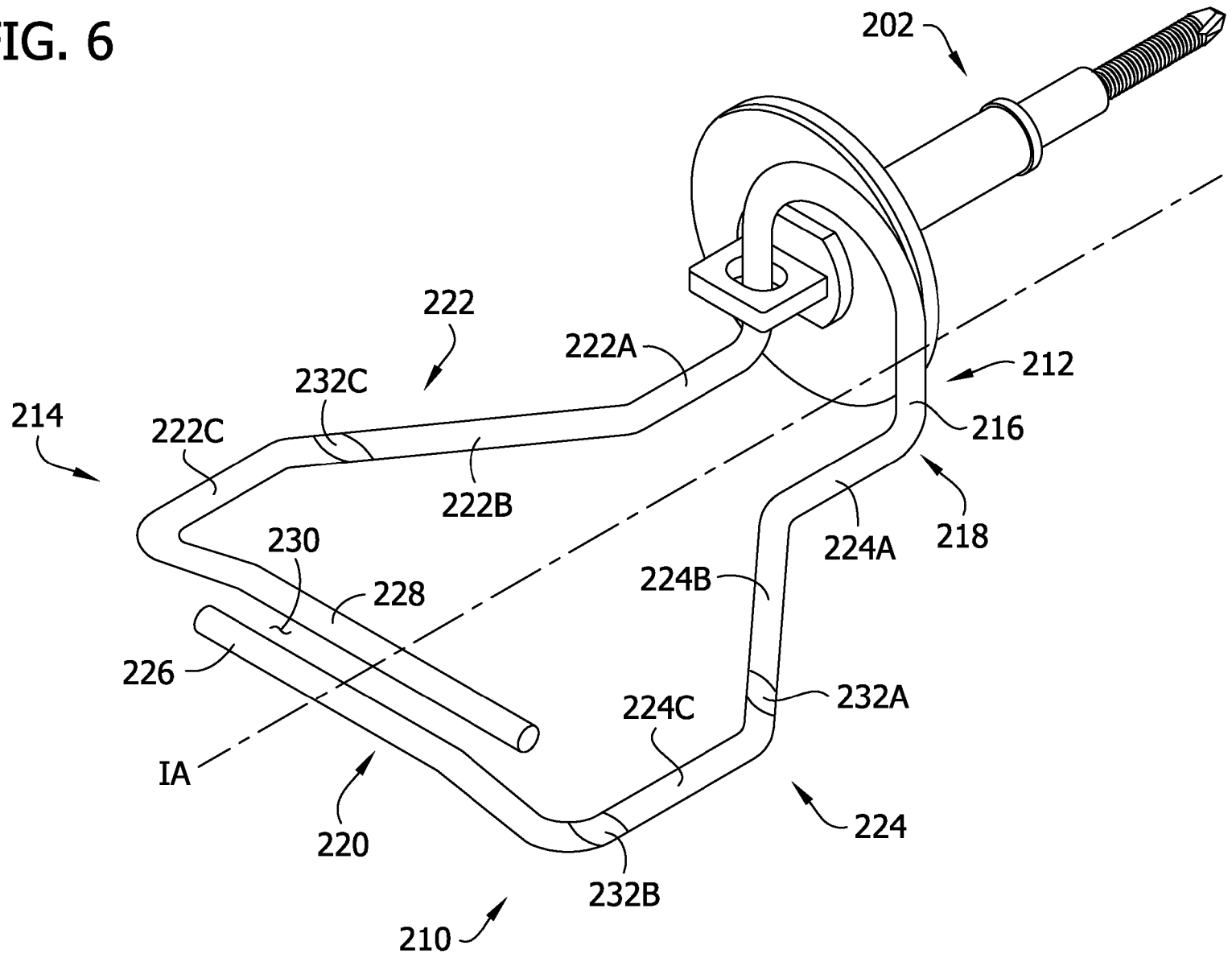
FIG. 6 is an enlarged perspective view of the veneer tie and a wall anchor of the anchoring system of FIG. 5.

Other configurations of the anchoring system 100 (e.g., veneer tie 110, wall anchor 102, wall reinforcement 104) are within the scope of the present disclosure. For example, another configuration of the anchoring system for securing an outer wall member 12 to an inner wall member 14 is generally shown at 200 in FIGS. 5 and 6. In this embodiment, anchoring system 200 includes the same wall reinforcement 104 as anchoring system 100 and different configurations of a veneer tie and a wall anchor. Anchoring system 200 includes a wall anchor 202. Wall anchor 202 is a driven wall anchor, further details of which may be found in U.S. Pat. Nos. 9,758,958 and 8,037,653, the entireties of which are hereby incorporated by reference. Other types of wall anchors, such as fasteners, for use with the anchoring systems 100, 200 disclosed herein are within the scope of the present disclosure.

The veneer tie 210 of anchoring system 200 is generally analogous to the veneer tie 110 of anchoring system 100 and, thus, for ease of comprehension, where similar or analogous parts are used, reference numerals "100" units higher are employed. Accordingly, unless clearly stated otherwise, the above descriptions regarding veneer tie 110 also apply to veneer tie 210. The veneer tie 210 includes an attachment portion 212 and an insertion portion 214. In this embodiment, the attachment portion 212 is an inverted, U-shaped wire segment 216. The insertion portion 214 is generally perpendicular to the attachment portion 212. The insertion portion 214 includes first and second segments 222, 224 and first and second free end segments 226, 228. In this embodiment, each of the first and second segments 222, 224 includes a first longitudinal section 222A, 224A, extending from the attachment portion 212, an angled section 222B, 224B extending from the respective first longitudinal section and a second longitudinal section 222C, 224C extending from the respective angled section. The longitudinal sections 222A, 222C, 224A, 224C are generally parallel to the installation axis IA. The angled sections 222B, 224B generally extend away from one another at an angle to the installation axis IA. In this embodiment, the first and third recesses 232A, 232C are disposed on the angled sections 222B, 224B respectively and the second recess 232B is disposed on the second longitudinal section 224C of the second segment 224. Other configurations of the insertion portion 214 are within the scope of the present disclosure.

Referring to FIGS. 7-11, another embodiment of an anchoring system for connecting an outer wall member 12 to an inner wall member 14 is generally shown at 300. As with the previous anchoring systems 100, 200, this anchoring system 300 includes a wall anchor 302, a veneer tie 310 and wall reinforcement 104. In this embodiment, the anchoring system 300 includes the same wall reinforcement 104 as anchoring system 100. The wall anchor 302 is a screw used to secure the veneer tie 310 to the inner wall member 14. Other configurations of the wall anchor 302 are within the scope of the present disclosure.

The veneer tie 310 includes an attachment portion 312 and an insertion portion 314. The attachment portion 312 is configured to be attached to the wall anchor 302 to secure the veneer tie 310 to the inner wall member 14. In the illustrated embodiment, the veneer tie 310 has a generally "L" shape. The attachment portion 312 includes a generally upstanding flange 316 that defines an elongate opening 317 sized and shaped to receive the wall anchor 302 therethrough. When the attachment portion 312 is secured to the inner wall member 14, the upstanding flange 316 generally lays flat against the outer surface 18 of the inner wall member. Other configurations of the attachment portion 312 are within the scope of the present disclosure. For example, the attachment portion 312 could include slots configured to receive vertical flanges of a wall anchor or could include a channel-tee configured to mate with a vertical channel of a wall anchor (not shown).

Figure 7:
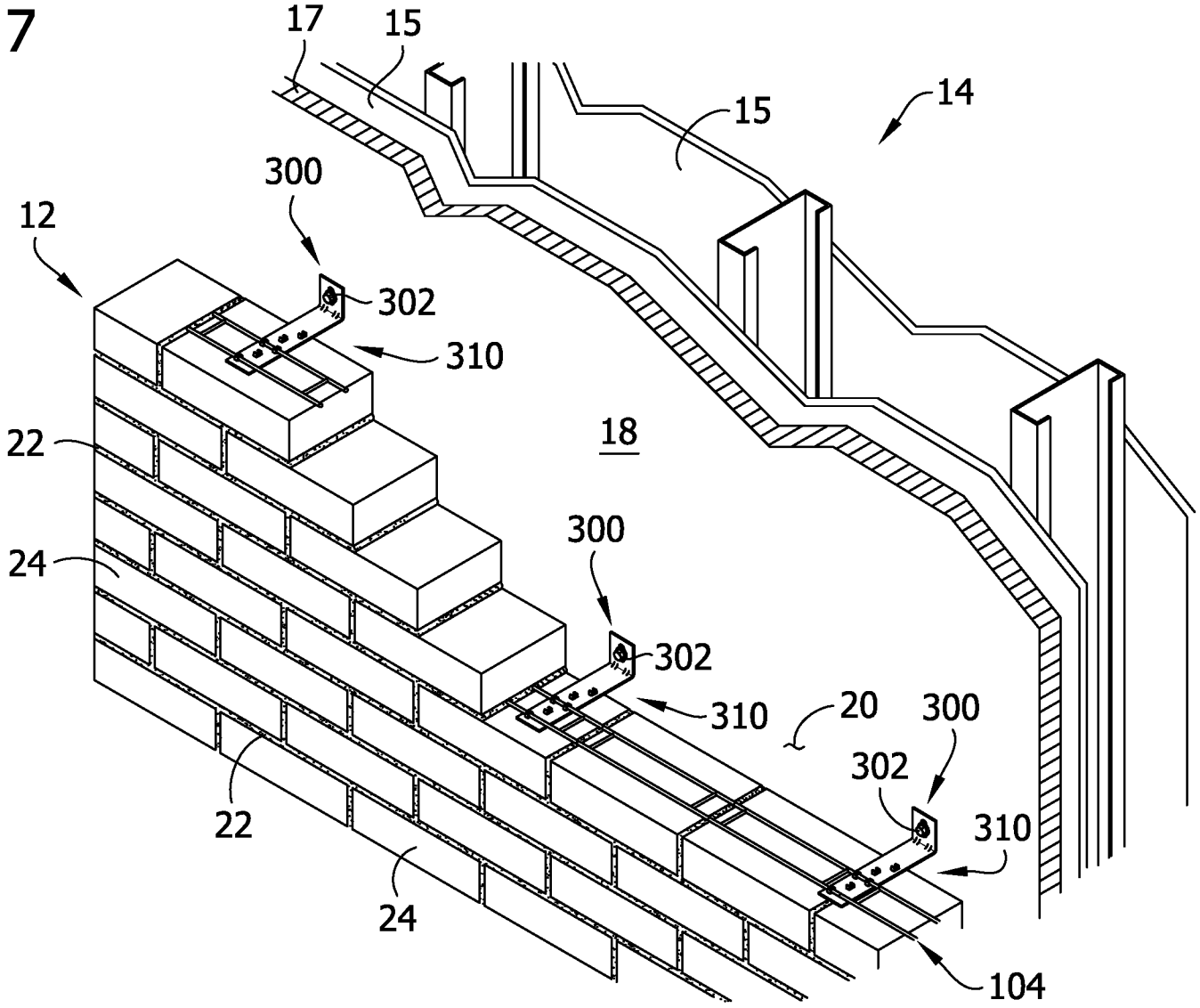
FIG. 7 is a perspective view of another anchoring system with a third embodiment of a veneer tie connecting an outer wall member to a stud frame inner wall member.

The insertion portion 314 of the veneer tie 310 is configured for disposition in a bed joint 22. The insertion portion 314 is coupled to or formed as one piece of material with the attachment portion 312. The insertion portion 314 generally extends outward in a direction from the attachment portion 312. In the illustrated embodiment, the insertion portion 314 is generally perpendicular to the attachment portion 312. As shown in FIG. 7, when installed, the insertion portion 314 extends generally horizontally across the cavity 20 to one of the bed joints 22 in the outer wall member 12. The insertion portion 314 has opposite first and second ends 318, 320. The first end 318 is joined with the attachment portion 312 and the second end 320 is a free end to be embedded within the mortar bed joint 22. The veneer tie 310 has an installation axis IA that extends generally perpendicularly to the outer wall member 12 when the veneer tie is used to join the inner wall member 14 and outer wall member (FIG. 2). In the illustrated embodiment, the installation axis IA of the veneer tie 310 generally extends between the first and second ends 318, 320 of the insertion portion 314. The insertion portion 314 includes a generally horizontal flange 322. The flanges 316, 322 are generally planar.

The insertion portion 314 includes a plurality of holders 324 (broadly, two, three, four, five, etc. or more holders). In the illustrated embodiment, the insertion portion 314 includes six holders 324A-F, although more or fewer holders are within the scope of the present disclosure. Each holder 324 is configured to receive and hold the wall reinforcement 104. Specifically, each holder 324 is configured to grip one of the first or second reinforcement members 106, 107 of the wall reinforcement 104 to couple the wall reinforcement to the veneer tie 310.

The holders 324 permit the wall reinforcement 104 to be coupled to the veneer tie 310 at different locations (e.g., different longitudinal locations). Each holder 324 is configured to receive and hold the wall reinforcement at a location in the direction along the installation axis IA different than at least one other holder. This allows a builder to select which holder or holders 324 receive the wall reinforcement 104 to compensate for construction variances between the inner and outer wall members 14, 12 by enabling the wall reinforcement to be installed at different positions on the veneer tie 310. The holders 324 are generally spaced part from one another in a direction parallel to installation axis IA. Specifically, each holder 324 is spaced apart from at least one other holder in a direction parallel to installation axis IA. Preferably, the distance between the outer most holders 324A, 324F (e.g., the holders closest to the ends 318, 220, respectively) is less than a width of the masonry units 24 so that all of the holders can overly the masonry unit, if needed. Each holder 324 includes opposing first and second tabs 326, 328. The first and second tabs 326, 328 are spaced apart from one another and define a wall reinforcement space 330 there between for receiving the wall reinforcement 104 (specifically, a reinforcement member 106, 107 thereof). The tabs 326, 328 include one end attached to the flange 322 and a free end disposed generally above the flange. The free ends of the tabs 326, 328 oppose and face another and define a gap through which the wall reinforcement 104 can be inserted through to be positioned in the wall reinforcement space 330. In one embodiment, each holder 324 is configured to snap-fit with the wall reinforcement 104. Preferably, the mouth is narrower than the wall reinforcement 104, thereby requiring the wall reinforcement 104 to deflect and push the tabs 326, 328 away from each other and out of the way in order to enter the wall reinforcement space 330. The tabs 326, 328 are resiliently deflectable and return (e.g., snap back) toward their original positions once the wall reinforcement 104 has passed through the mouth. In the illustrated embodiment, the tabs 326, 328 are struck from the material of the flange 322 and bent upward.

Figure 8:
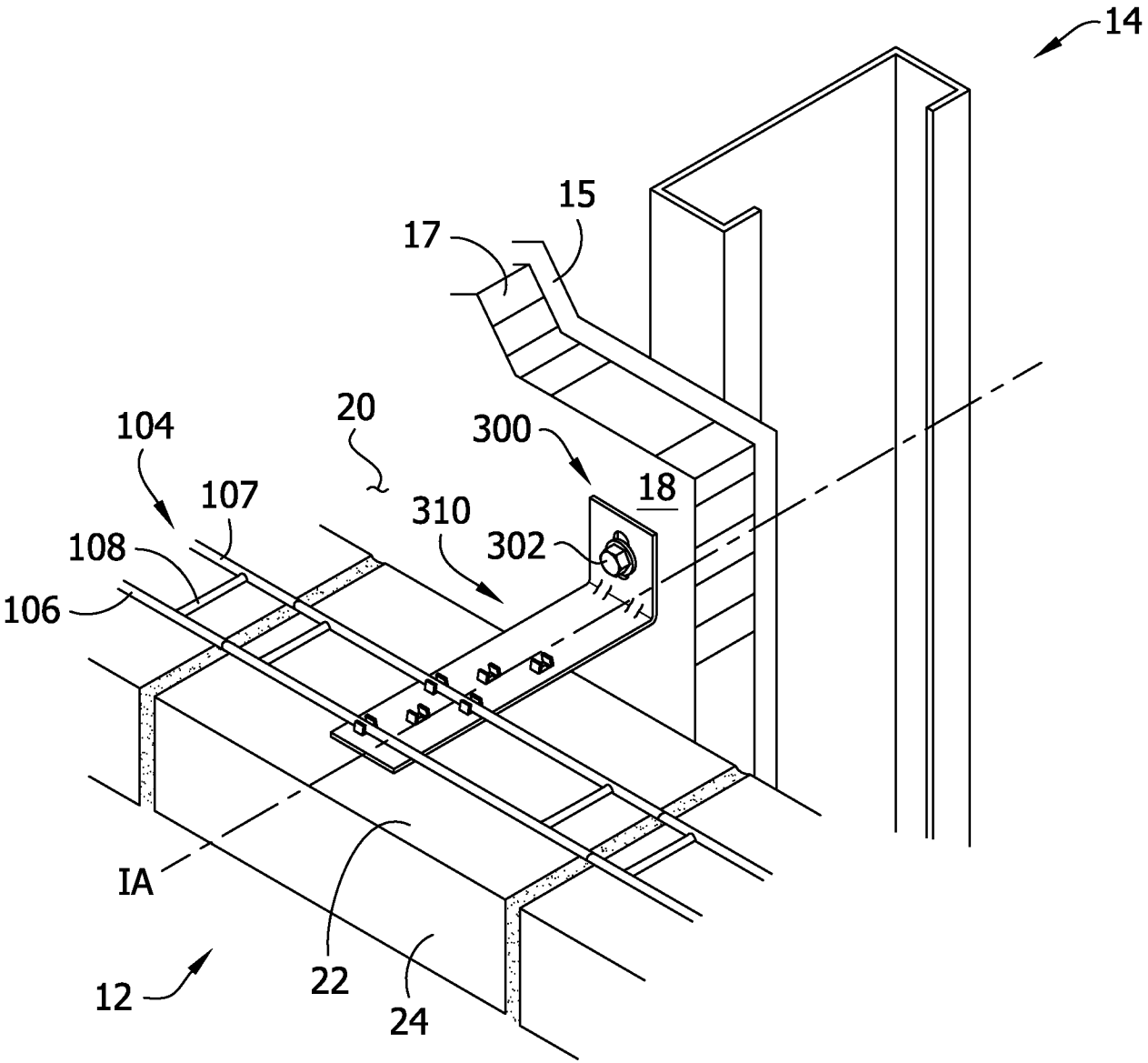
FIG. 8 is an enlarged, fragmentary view of the anchoring system of FIG. 7, with wall reinforcement of the anchoring system at a first position on the veneer tie.
Figure 9:
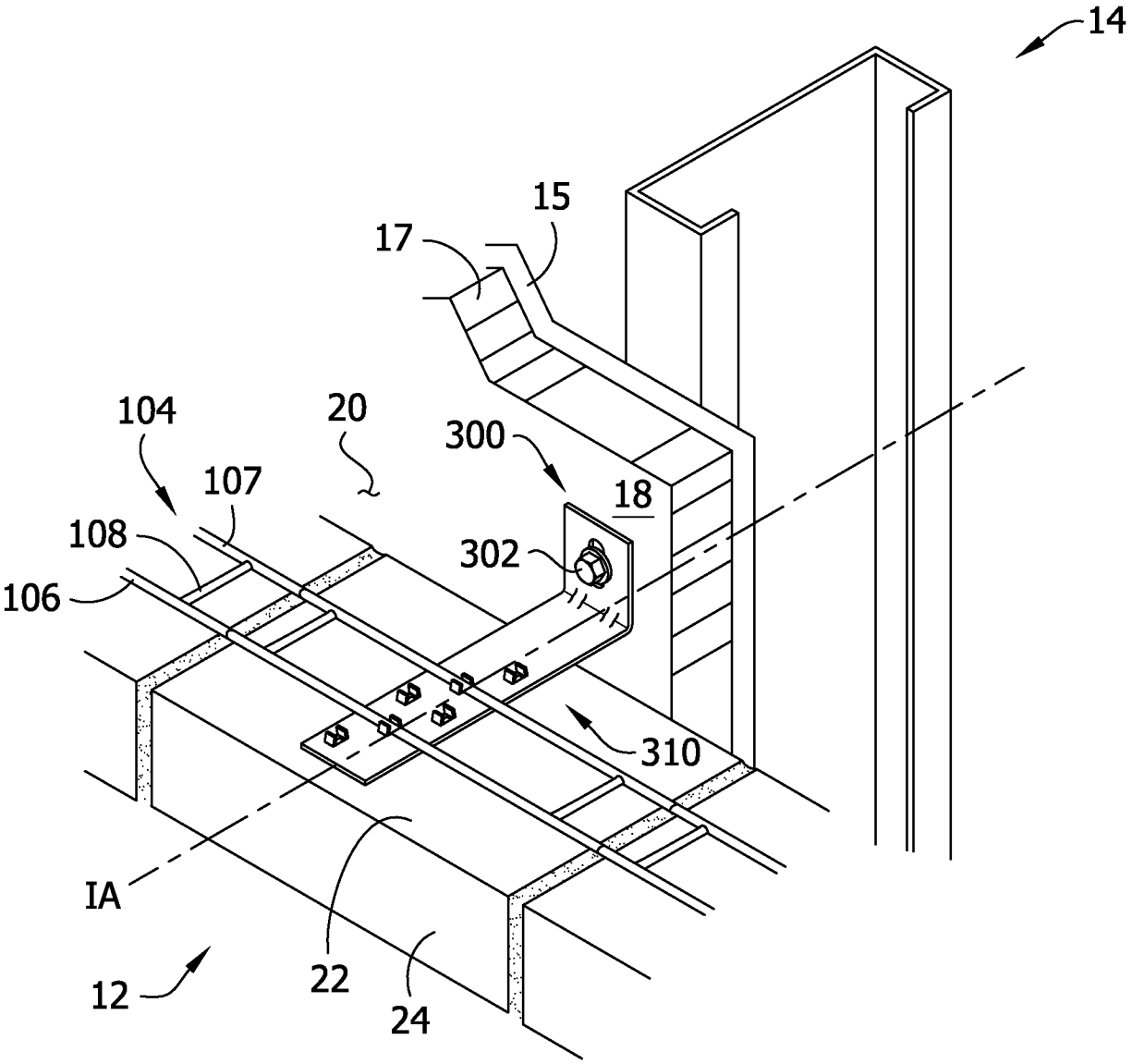
FIG. 9 is similar to FIG. 8, with the wall reinforcement at a second position on the veneer tie.
Figure 10:
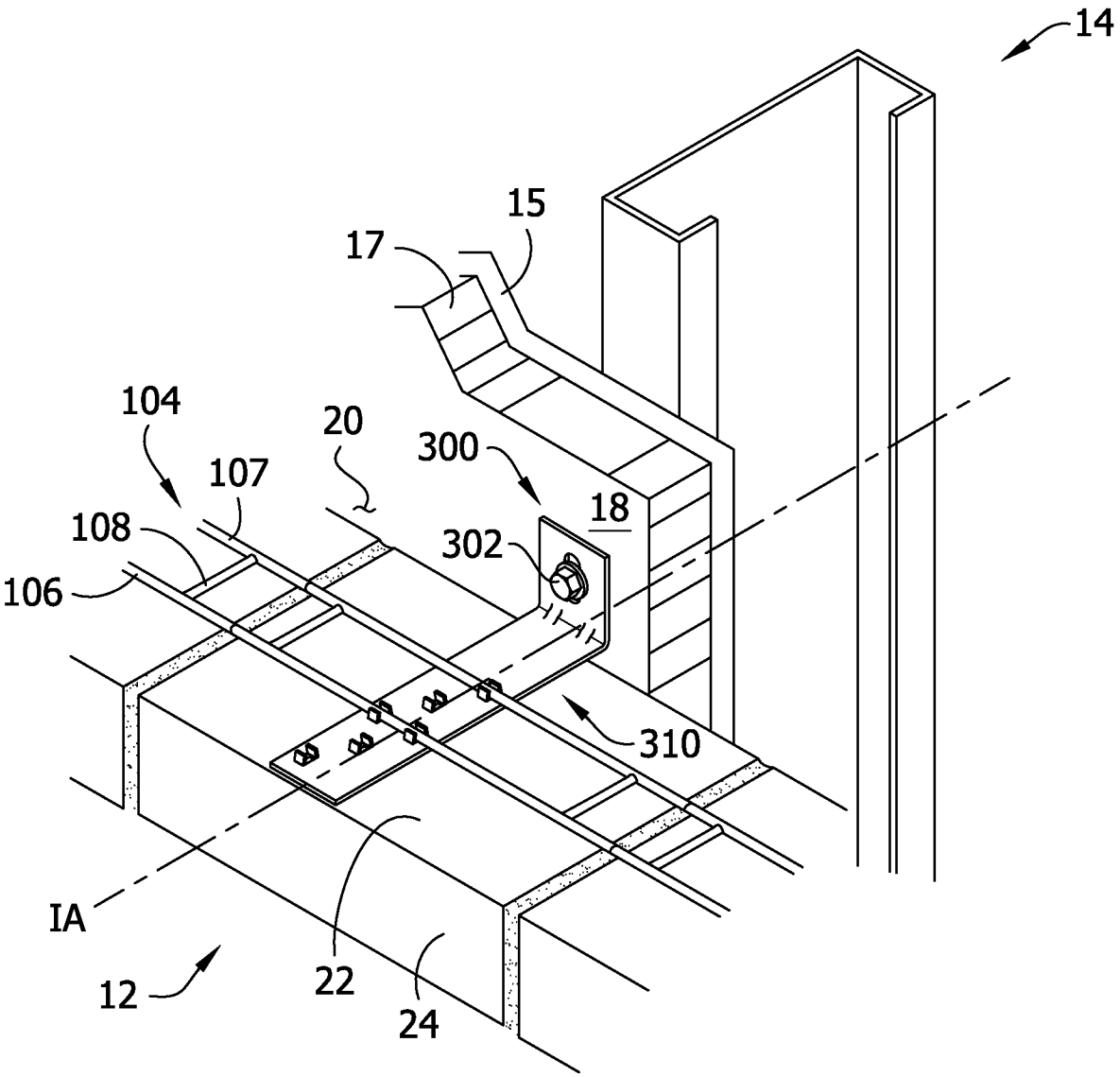
FIG. 10 is similar to FIG. 8, with the wall reinforcement at a third position on the veneer tie.
Figure 11:
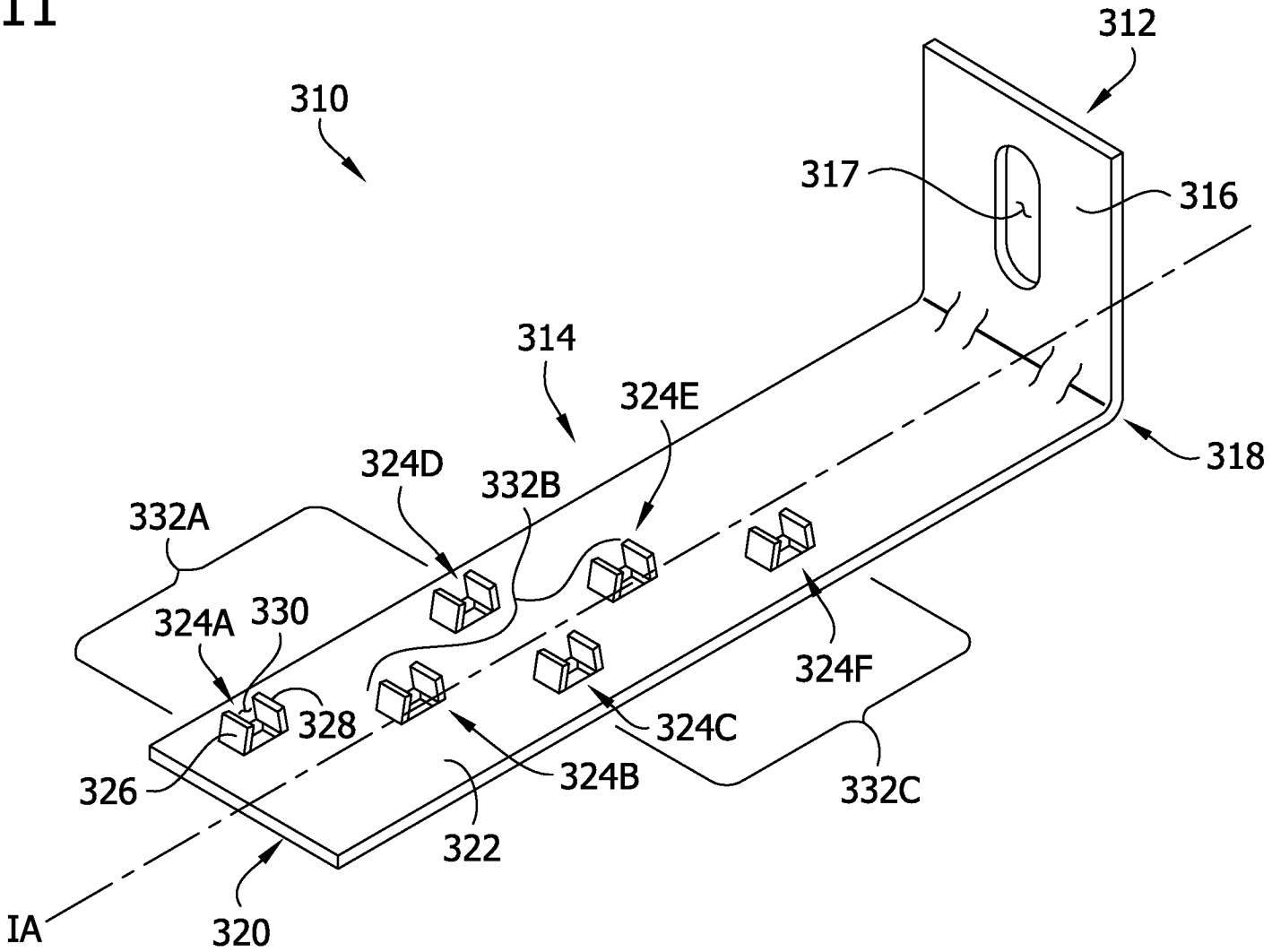
FIG. 11 is a perspective view of the veneer tie of FIG. 7.

In the illustrated embodiment, the holders 324 are arranged into a plurality of holder sets 332 (broadly, two or more holder sets). In the illustrated embodiment, there are three holder sets 332A-C, although more or fewer holder sets are within the scope of the present disclosure. Each holder set 332 is configured to receive and hold the wall reinforcement 104 at a location different than the other holder sets (broadly, two or more locations). The first holder set 332A receives and holds the wall reinforcement 104 at an outer or first location or position on the veneer tie 310 (FIG. 8). The second holder set 332B receives and holds the wall reinforcement 104 at an intermediate or second location on the veneer tie 310 (FIG. 9). The third holder set 332C receives and holds the wall reinforcement 104 at an inner or third location on the veneer tie 310 (FIG. 10). Thus, the holder sets 332, like the holders 324, are spaced apart from one another in a direction parallel to the installation axis IA. In the illustrated embodiment, each holder set 332 includes two holders 324 (broadly, at least two holders) of the plurality of holders. The two holders 324 of each holder set 332 are spaced apart in a direction parallel to the installation axis IA so that one holder of each holder set connects to the first reinforcement member 106 of the wall reinforcement 104 and the other holder of the holder set connects to the second reinforcement member 107 of the wall reinforcement. For example, the first holder set 332A includes the first holder 324A which connects to the first reinforcement member 106 and the fourth holder 324D which connects to the second reinforcement member 107 to position the wall reinforcement 104 at the first location (FIG. 8). The second holder set 332B includes the second holder 324B which connects to the first reinforcement member 106 and the fifth holder 324E which connects to the second reinforcement member 107 to position the wall reinforcement 104 at the second location (FIG. 9). The third holder set 332C includes the third holder 324C which connects to the first reinforcement member 106 and the sixth holder 324F which connects to the second reinforcement member 107 to position the wall reinforcement 104 at the third location (FIG. 10). In the illustrated embodiment, the holders 324 of each holder set 332 are axially aligned, with each holder set being laterally spaced apart. In this embodiment, the third and fourth holders 324C, 324D of the first and third holder sets 332A, 332C, respectively, are laterally aligned so that depending upon the location of the wall reinforcement 104, a respective one of the reinforcement members 106, 107 is received in both the third and fourth holders. The holder sets 332 include two holders 324 in order to connect to the first and second reinforcement members 106, 107 of the wall reinforcement 104. It is understood the holder sets 332 may contain more or fewer (e.g., one) holders, the number and arrangement of which may in part be based on the particular configuration of the wall reinforcement coupled to the veneer tie 310. Accordingly, other arrangements of the holders 324 are within the scope of the present disclosure.

In operation, the wall anchor 302 is used to secure the veneer tie 310, via the attachment portion 312, to the inner wall member 14. The insertion portion 314 is in a substantially horizontal plane with the bed joint 22. The insertion portion 314 extends across the cavity 20 into the bed joint 22. The wall reinforcement 104 extends along the bed joint 22 and overlies the insertion portion 314. The wall reinforcement 104 is inserted into the holders 324 (e.g., holder sets 332) which position the wall reinforcement most centrally within the bed joint 22. The wall reinforcement 104 and insertion portion 314 are surrounded by (e.g., embedded within) the mortar and secured within the bed joint 22.

The veneer tie 310 of the anchoring system 300 is formed from a piece of material having a generally planar shape. In the illustrated embodiment, the veneer tie 310 comprises a unitary piece of material having a generally "L" shape. The material may be sheet metal or any other suitable material capable of providing a robust connection between the outer wall member 12 and the inner wall member 14. In one embodiment, the veneer tie 310 is stamped from a unitary piece of sheet metal and bent into shape. A blank can be cut from a piece of sheet metal and then bent, cut, stamped, struck, etc. into shape. For example, the tabs 326, 328 of each holder 324 may be struck out from the piece of sheet metal.

Components between anchoring systems 100, 200, 300 are generally interchangeable. For example, wall anchors 102 and 202 are interchangeable.

Having described the disclosure in detail, it will be apparent that modifications and variations are possible without departing from the scope of the disclosure defined in the appended claims.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products without departing from the scope of the disclosure, it is intended that all matter contained in the above description and shown in the accompanying drawings shall be interpreted as illustrative and not in a limiting sense.

What is claimed is:

1. An anchoring system for use in a wall to join an inner wall member and an outer wall member of the wall, the outer wall member formed from a plurality of successive courses of masonry units with a mortar-filled bed joint between each two adjacent courses, the anchoring system comprising:

a wall anchor configured to be secured to the inner wall member;

a wall reinforcement configured for disposition in the bed joint, the wall reinforcement including a first reinforcement member and a second reinforcement member; and a veneer tie configured to be coupled to the wall anchor and the wall reinforcement, the veneer tie having an installation axis extending generally perpendicular to the outer wall member when the veneer tie is used to join the inner wall member to the outer wall member, the veneer tie including:

an attachment portion configured to be coupled to the wall anchor; and an insertion portion fixed to the attachment portion and configured for disposition in the bed joint, the insertion portion including a first recess and a second recess, the first recess disposed at a first location on the insertion portion and the second recess disposed at a second location on the insertion portion, the first and second locations being spaced apart from one another in a direction parallel to the installation axis, the first recess configured to receive the first reinforcement member of the wall reinforcement and the second recess configured to receive the second reinforcement member of the wall reinforcement, wherein the insertion portion of the veneer tie has an insertion portion height and the wall reinforcement has a wall reinforcement height, wherein a combined height extending from a lower end of the insertion portion to an upper end of the wall reinforcement is less than the sum of the insertion portion height and the wall reinforcement height when the first and second reinforcement members are received in the first and second recesses, and wherein the insertion portion height is greater than the wall reinforcement height.

2. The anchoring system of claim 1, wherein each of the first and second recesses has a recess height, wherein the recess height is equal to or greater than the wall reinforcement height.

3. The anchoring system of claim 2, wherein the combined height is equal to or less than half a bed joint height of the bed joint.

4. The anchoring system of claim 1, wherein the first and second reinforcement members have arcuate cross-sections and the first and second recesses are swaged to correspond to the arcuate cross-sections.

5. The anchoring system of claim 1, wherein the insertion portion includes a third recess disposed at one of the first or second locations on the insertion portion and laterally spaced apart from said one of the first or second recesses, the third recess being configured to receive either the first or second reinforcement member of the wall reinforcement.

6. The anchoring system of claim 1, wherein the first and second reinforcement members are spaced apart relative to the direction along the installation axis of the veneer tie.

7. The anchoring system of claim 1, wherein the first and second reinforcement members are separated by a first distance and the first and second recesses are separated by a second distance, wherein the first and second distances are generally the same.

8. The anchoring system of claim 5, wherein the insertion portion is free of a fourth recess configured to receive either the first or second reinforcement member of the wall reinforcement.

9. The anchoring system of claim 8, wherein the insertion portion defines a gap, the gap disposed at the other of the first or second locations on the insertion portion such and laterally spaced apart from said other one of the first or second recesses, the gap sized and shaped to receive the other of the first or second reinforcement member of the wall reinforcement.

10. The anchoring system of claim 9, wherein the insertion portion includes spaced apart first and second segments defining the gap therebetween.

* * * * *